US009666148B2

(12) United States Patent
Dunn et al.

(10) Patent No.: US 9,666,148 B2
(45) **Date of Patent: *May 30, 2017**

(54) REDUNDANT POWER/CONTROL SYSTEM FOR LIQUID CRYSTAL DISPLAYS

(71) Applicant: American Panel Corporation, Alpharetta, GA (US)

(72) Inventors: William Dunn, Alpharetta, GA (US); Ken Mahdi, Alpharetta, GA (US)

(73) Assignee: American Panel Corporation, Alpharetta, GA (US)

( * ) Notice: Subject to any disclaimer, the term of this patent is extended or adjusted under 35 U.S.C. 154(b) by 49 days.

This patent is subject to a terminal disclaimer.

(21) Appl. No.: 14/833,786

(22) Filed: Aug. 24, 2015

(65) Prior Publication Data

US 2015/0364100 A1 Dec. 17, 2015

Related U.S. Application Data

(63) Continuation of application No. 14/258,347, filed on Apr. 22, 2014, now Pat. No. 9,117,417, which is a continuation of application No. 13/080,354, filed on Apr. 5, 2011, now Pat. No. 8,704,751.

(60) Provisional application No. 61/321,084, filed on Apr. 5, 2010.

(51) Int. Cl.
*G09G 3/36* (2006.01)
*G09G 3/34* (2006.01)

(52) U.S. Cl.
CPC ..... *G09G 3/3611* (2013.01); *G09G 3/3406* (2013.01); *G09G 3/3607* (2013.01); *G09G 3/3648* (2013.01); *G09G 2310/0237* (2013.01); *G09G 2320/041* (2013.01); *G09G 2320/08* (2013.01); *G09G 2330/08* (2013.01); *G09G 2360/14* (2013.01)

(58) Field of Classification Search
None
See application file for complete search history.

(56) References Cited

U.S. PATENT DOCUMENTS

| | | | | |
|---|---|---|---|---|
| 6,099,145 | A | 8/2000 | Sendova et al. | |
| 7,012,382 | B2 | 3/2006 | Cheang et al. | |
| 7,293,907 | B2 | 11/2007 | Kim et al. | |
| 7,465,079 | B1 | 12/2008 | Cull et al. | |
| 7,502,950 | B1 * | 3/2009 | Brands | G06F 3/1446 323/234 |
| 8,704,751 | B2 | 4/2014 | Dunn et al. | |
| 9,117,417 | B2 * | 8/2015 | Dunn | G09G 3/3406 |
| 2005/0242742 | A1 | 11/2005 | Cheang et al. | |

(Continued)

*Primary Examiner* — Kenneth B Lee, Jr.
(74) *Attorney, Agent, or Firm* — Standley Law Group LLP

(57) ABSTRACT

A system for powering and controlling an LED-backlit liquid crystal display (LCD) where redundancy is used to provide two independent paths from a pair of power supplies to the LED backlight. Further, two independent paths are also used from a pair of power supplies to the LCD. If any one of the paths were to fail or begin to degrade in performance, the system contains monitoring circuits which can direct another path to be used by the system. Two separate control circuits for the LCD may be used so that either one may be used to control the LCD if one were to fail. Two separate temperature sensors and luminance sensors may also be used to increase the durability of the system.

20 Claims, 3 Drawing Sheets

(56) References Cited

U.S. PATENT DOCUMENTS

| | | | | |
|---|---|---|---|---|
| 2008/0024480 | A1* | 1/2008 | Jee | G06F 1/3203 345/212 |
| 2008/0045275 | A1* | 2/2008 | Le | G06F 1/263 455/572 |
| 2008/0068293 | A1* | 3/2008 | Ishii | G09G 3/20 345/3.1 |
| 2009/0153464 | A1* | 6/2009 | Furukawa | G02F 1/133603 345/102 |
| 2009/0273764 | A1 | 11/2009 | D'Alessio et al. | |

* cited by examiner

REDUNDANT POWER/CONTROL SYSTEM FOR LIQUID CRYSTAL DISPLAYS

CROSS-REFERENCE TO RELATED APPLICATIONS

This application is a continuation of U.S. application Ser. No. 14/258,347, filed on Apr. 22, 2014, now U.S. Pat. No. 9,117,417 issued Aug. 25, 2015, which is a continuation of U.S. application Ser. No. 13/080,354 filed on Apr. 5, 2011, now U.S. Pat. No. 8,704,751 issued Apr. 22, 2014, which is a non-provisional application of U.S. Application No. 61/321,084 filed on Apr. 5, 2010. All aforementioned applications are hereby incorporated by reference in their entirety as if fully cited herein.

TECHNICAL FIELD

Disclosed embodiments relate generally to a redundant control system architecture for a liquid crystal display device.

BACKGROUND ART

Liquid Crystal Displays (LCDs) contain several layers which work in combination to create a viewable image. A backlight is used to generate the rays of light that pass through what is commonly referred to as the LCD stack, which typically contains several layers that perform either basic or enhanced functions. The most fundamental layer within the LCD stack is the liquid crystal material, which may be actively configured in response to an applied voltage/charge in order to pass or block a certain amount of light which is originating from the backlight. The layer of liquid crystal material is divided into many small regions which are typically referred to as pixels. For full-color displays these pixels are further divided into independently-controllable regions of red, green and blue subpixels, where the red subpixel has a red color filter, blue subpixel has a blue color filter, and green subpixel has a green color filter.

The light which is passing through each subpixel typically originates as "white" (or broadband) light from the backlight, although in general this light is far from being uniform across the visible spectrum. The subpixel color filters allow each subpixel to transmit a certain amount of each color (red, green or blue). When viewed from a distance, the three subpixels appear as one composite pixel and by electrically controlling the amount of light which passes through each subpixel, the composite pixel can produce a very wide range of different colors due to the effective mixing of light from the red, green, and blue subpixels.

Currently, the common and preferable illumination source for LCD backlight assemblies is light emitting diodes (LEDs). Environmental concerns, small space requirements, lower energy consumption, and long lifetime are some of the reasons that the LCD industry is beginning the widespread usage of LEDs for backlights.

LCDs are becoming popular for not only home entertainment purposes, but are now being used as informational/advertising displays in both indoor and outdoor locations. When used for information/advertising purposes, the displays may remain 'on' for extended periods of time and thus would see much more use than a traditional home theatre use. Further, when displays are used in areas where the ambient light level is fairly high (especially outdoors or in aircraft cockpits) the displays must be very bright in order to maintain adequate picture brightness. When used for extended periods of time and/or outdoors, durability of the components can become an issue.

Modern LCD devices have become more sophisticated and now use a plurality of sensors and logic to maintain optimal performance. As is readily apparent, an LCD will not function satisfactorily without an appropriate and properly-functioning control system. The backlight is also essential for proper functioning as the image or data displayed on the liquid crystal layer may only be viewed while the backlight is providing proper illumination to the liquid crystal stack. If the backlight system should fail completely or operate at a less than optimal level, then the LCD will not perform satisfactorily. While this may be a simple inconvenience when LCDs are used for entertainment purposes, when used for information or data displays this can be very costly. For example, LCDs are now being used in aircraft cockpits as well as the instrument panels or display(s) in ground vehicles and marine equipment. In these applications, when there is a failure within the control system, the LCD may no longer display the important information for the vehicle/aircraft and controls may cease to operate. These situations can be undesirable not only to the passengers of the vehicle/aircraft, but also other soldiers/team members who are counting on this part of the mission.

Some control systems have a limited life span, and eventually their performance may suffer. Some systems may quickly fail simply due to a manufacturing defect or may fail due to shock/forces applied to the aircraft or ground vehicle. Currently when this occurs, the entire LCD device must be manually replaced. This is expensive, and is often time consuming. Alternatively, the LCD device could be removed from the display housing, and the degraded or faulty system elements could be manually replaced. This is typically even more costly, and involves extensive manual labor. In currently known units, this also requires virtual complete disassembly of the LCD to gain access to the electronics. This complete disassembly is not only labor intensive, but must be performed in a clean room environment and involves the handling of expensive, delicate, and fragile components that can be easily damager or destroyed, even with the use of expensive specialized tools, equipment, fixtures, and facilities.

Thus, there exists a need for a more durable and dependable control system for an LCD so that failures can be accounted for and vehicles/aircraft can complete a mission and/or return safely to base.

SUMMARY

Exemplary embodiments provide a power and control system for an LCD device where redundancy is used to create a system that is robust and can continue operations even upon a failure in the control system, power module, sensors, or other electronic assembly within.

Arbiter logic is used to constantly monitor any deviation in operating power supplies or logic control signals. The preferred embodiments provide two independent paths for signals and power to flow to the LCD and LED backlight thereby any failure or deviation in these signals that prevents the display from working properly can be eliminated.

DETAILED DESCRIPTION

Figure 1:
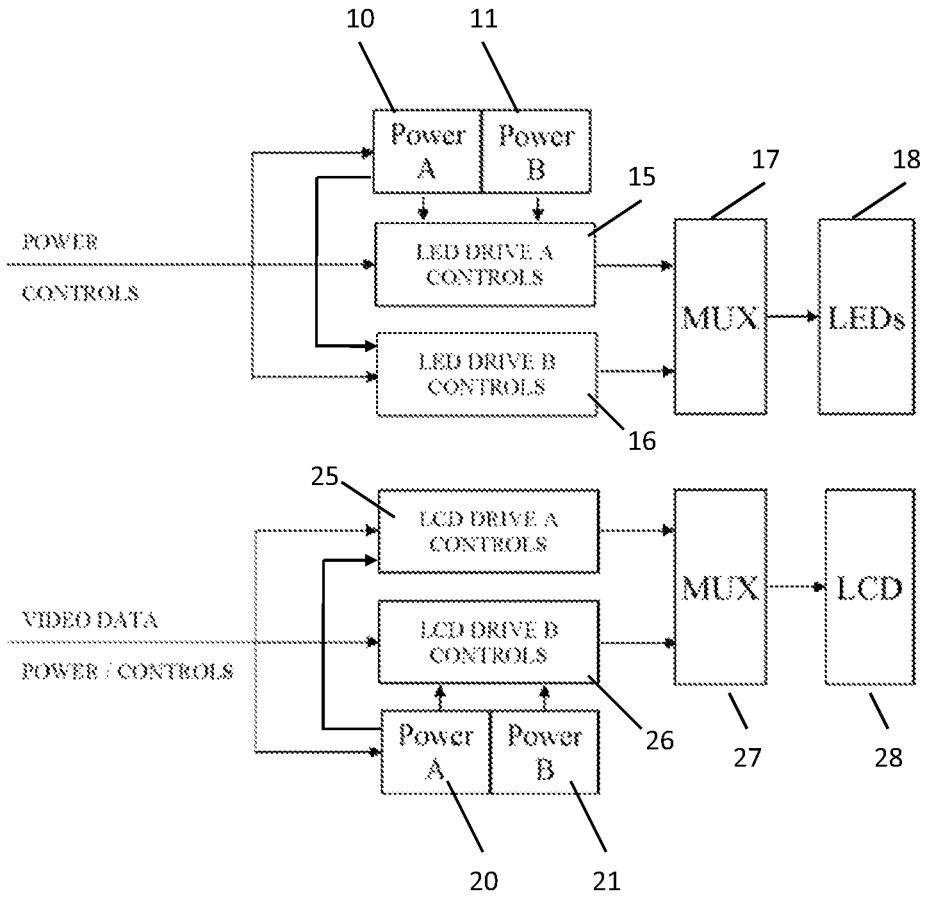
FIG. 1 shows an electrical block diagram of an embodiment for the overall system architecture of a redundant power/control system.

FIG. 1 shows an electrical block diagram of an embodiment for the overall system architecture of a redundant power/control system. In this embodiment, there are dual redundant paths of required DC power and associated control signals for the LCD 28 and the LED backlight 18. For the backlight section of this embodiment, two independent power supplies 10 and 11 may provide power to the LED controls and drive circuitry. There may be two independent circuits 15 and 16 for driving and controlling the LEDs. The back-end circuitry and components may provide the control signals and power for the LED drive controls 15 and 16 as well as the power supplies 10 and 11.

For the LCD section of this embodiment, two independent power supplies 20 and 21 may provide power to the LCD controls 28 and drive circuitry 27. There are two independent circuits 25 and 26 for driving and controlling the LCD. The back-end circuitry and components may provide the source controls/power and video data for the LCD drive controls 25 and 26 as well as the power supplies 20 and 21.

The two independent paths for the LED backlight 18 and LCD 28 are multiplexed (see MUX 17 and 27 respectively) to provide one set of inputs to the LEDs 18 and LCD 28. The control signals to the multiplexers 17 and 27 may be provided through Arbiter logic which may be constantly monitoring any deviation in operating power supplies or logic control signals. This scheme provides two independent paths for signals and power to flow to the LCD 28 and LEDs 18 such that any failure or deviation in one path allows the assembly to switch to the alternative path.

It should be noted that the diagram in FIG. 1 is simplified to simply provide an outline of the overall system architecture. Additional details on the LCD controls and the LED backlight controls are provided in FIGS. 2 and 3 respectively.

Figure 2:
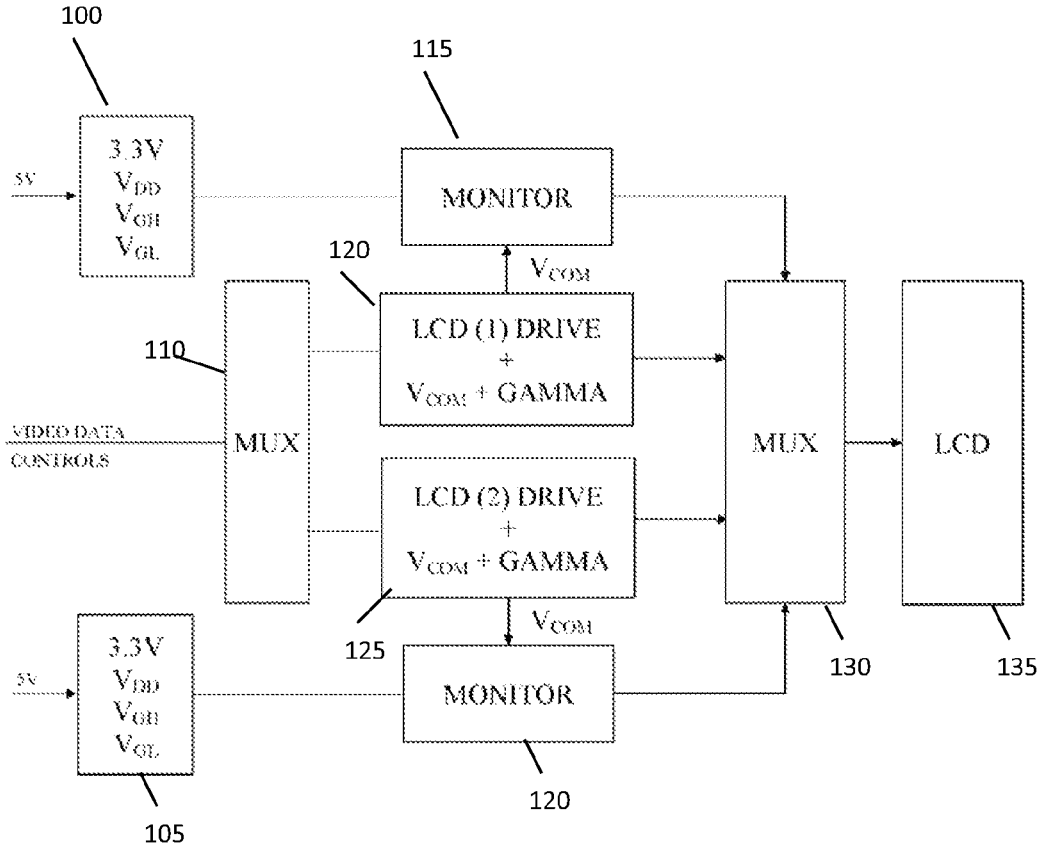
FIG. 2 shows an electrical block diagram of an embodiment for a redundant LCD power/control system.

FIG. 2 shows an electrical block diagram of an embodiment for a redundant LCD power/control system. This embodiment provides two independent paths for video data, controls, and power to the LCD. Two sets of power supplies 100 and 105 may be used to generate the LCD power (for example 3.3V, $V_{DD}$, $V_{GH}$, and $V_{GL}$). The power supplies 100 and 105 are monitored continuously by monitoring circuitry 115 and 120 respectively for any deviation or loss. Arbitration logic may be used to select the appropriate set for the associated LCD drive and gamma control. In addition, there are two sets of LCD control circuits (drive, $V_{com}$, and Gamma generation circuits) 120 and 125 that are monitored continuously. The arbitration logic may be used to select the appropriate set to be channeled to the LCD 135 via the multiplex logic contained within the multiplexer 130. The video data may also be multiplexed and channeled appropriately by a multiplexer 110 prior to being sent to the circuits 120 and 125.

It should be noted that although two separate monitoring circuits 115 and 120 are shown, some embodiments may combine these into a single circuit for monitoring the electrical communication from the power supplies 100 and 105 as well as the communications from the LCD control circuits 120 and 125.

Figure 3:
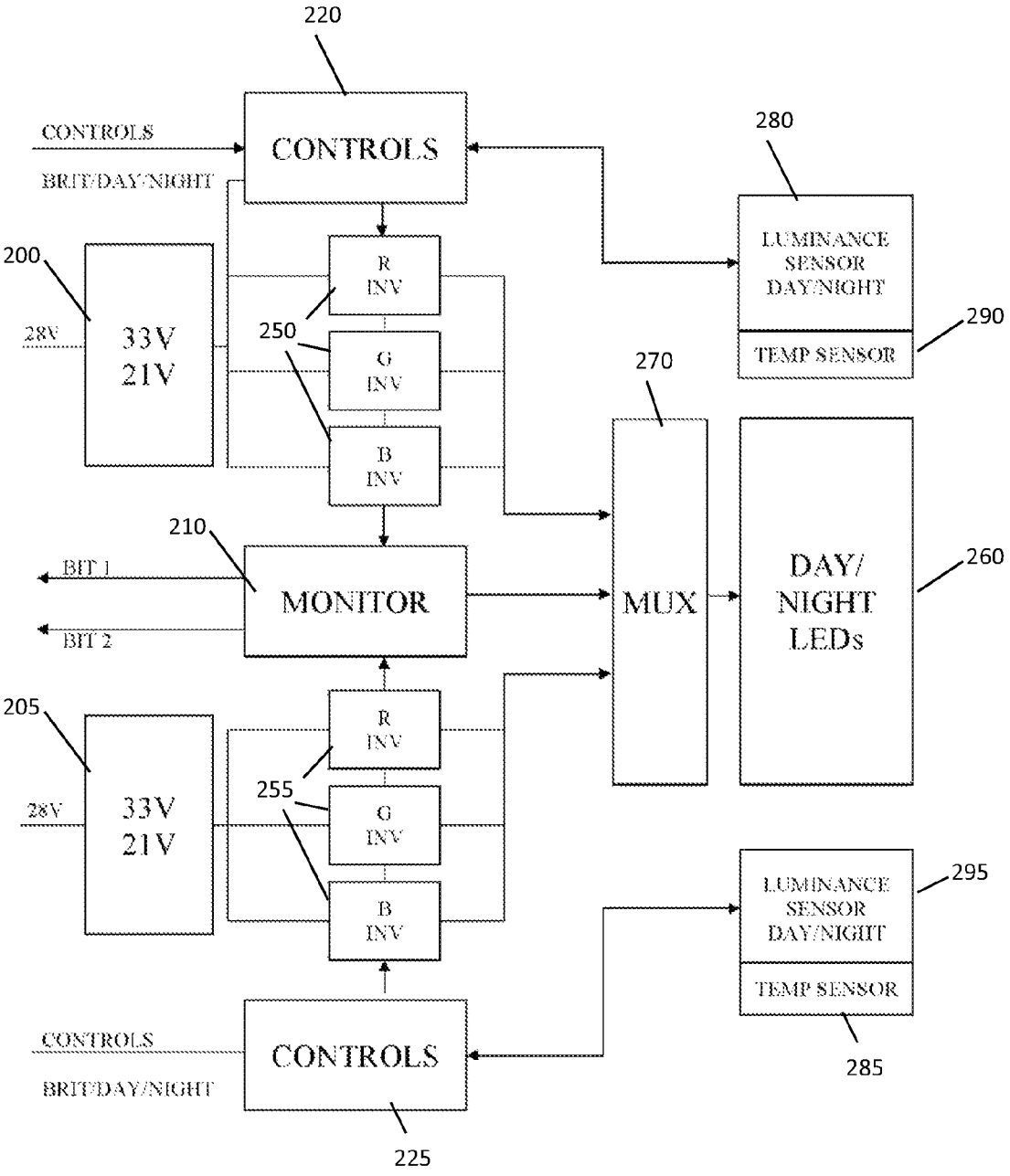
FIG. 3 shows an electrical block diagram of an embodiment for a redundant backlight power/control system.

FIG. 3 shows an electrical block diagram of an embodiment for a redundant backlight power/control system. A first power supply 200 is in electrical communication with a power inverter 250 while a second power supply 205 is in electrical communication with a second power inverter 255. Both power inverters 250 and 255 are in electrical communication with monitoring circuitry 210 which continuously analyzes the signals coming from the power inverters 250 and 255 to determine if one or more components have failed or started to malfunction. The monitoring circuitry 210 may determine if the signal has unexpected deviations or stops altogether and may switch from one set of power supply/power inverter/control circuit to the other. This switch can take place in a matter of milliseconds, providing little to no interruption of the display performance.

The controlling signals for the LED backlight are sent to a first control circuit 220 which also accepts input from a first temperature sensor 290 and first luminance sensor 280. Accordingly, the controlling signals for the LED backlight are also sent to a second control circuit 225 which also accepts input from a second temperature sensor 285 and second luminance sensor 295. The output signals from the power inverters 250 and 255 as well as the output signal from the monitoring circuitry 210 may be multiplexed with multiplexer 270, and then sent to the LEDs 260.

It should be noted that in embodiments used for night operations, there may actually be two sets of LEDs (one for daytime and one for nighttime operations). This is certainly not required but this embodiment can be used if both daytime and nighttime LEDs are being used.

It should also be mentioned that although shown as a RGB setup, there are many methods for generating white light for the backlight and any method could be used with the embodiments herein. Some embodiments may use several colored LEDs in any combination to create the color white. Sometimes this may be done with a pair of LEDs consisting of a red-green and a red-blue LED that combine to create white. Some embodiments may only use white LEDs for the backlight.

As shown herein, the overall system architecture shown in FIG. 1 may use the LCD control system shown in FIG. 2 or may use other designs. Similarly, the overall system architecture shown in FIG. 1 may use the backlight control system shown in FIG. 3 or may use other designs. It should also be noted that the voltages shown in the Figures are only for illustration and should not be used to limit the exemplary embodiments to such voltages.

Having shown and described preferred embodiments of the invention, those skilled in the art will realize that many variations and modifications may be made to affect the described embodiments and still be within the scope of the claimed invention. Additionally, many of the elements indicated above may be altered or replaced by different elements which will provide the same result and fall within the spirit of the exemplary embodiments. It is the intention, therefore, to limit the invention only as indicated by the scope of the claims.

What is claimed is:

1. An electronic display assembly comprising:

a first power supply;

a second power supply;

an LED backlight;

a first LED control circuit accepting backlight control signals and in electrical connection with the first and second power supplies;

a second LED control circuit accepting backlight control signals and in electrical connection with the first and second power supplies;

a multiplexer in electrical connection with the first and second LED control circuits and the LED backlight; and a liquid crystal display (LCD) positioned in front of the LED backlight;

wherein the multiplexer is configured to receive an input from each of the first and second LED control circuits and provide a single output to the LED backlight.

2. The display assembly of claim 1 further comprising:

a monitoring circuit in electrical connection with the first and second power supply and first and second LED control circuit.

3. The display assembly of claim 2 wherein:

the monitoring circuit is adapted to analyze the signals from the first and second power supply to determine if the signal has been interrupted.

4. The display assembly of claim 2 wherein:

the monitoring circuit is adapted to instruct the multiplexer as to which LED control circuit signal to send to the LED backlight.

5. The display assembly of claim 2 further comprising:

a first luminance sensor in electrical connection with the first LED control circuit; and a second luminance sensor in electrical connection with the second LED control circuit.

6. The display assembly of claim 5 wherein:

the monitoring circuit is adapted to analyze the signals from the first and second luminance sensors to determine if the signal has been interrupted.

7. The display assembly of claim 6 further comprising:

a first temperature sensor in electrical connection with the first LED control circuit; and a second temperature sensor in electrical connection with the second LED control circuit.

8. The display assembly of claim 7 wherein:

the monitoring circuit is adapted to analyze the signals from the first and second temperature sensors to determine if the signal has been interrupted.

9. An electronic display assembly comprising:

a first power supply;

a second power supply;

a liquid crystal display (LCD);

a first LCD control circuit in electrical connection with the first and second power supplies;

a second LCD control circuit in electrical connection with the first and second power supplies; and a first multiplexer in electrical connection with the first and second LCD control circuits and the LCD, wherein the first multiplexer is configured to receive input signals from each of the first and second LCD control circuits and provide a single input signal to the LCD.

10. The display assembly of claim 9 further comprising:

a second multiplexer which multiplexes the incoming video data before sending it to the first and second LCD control circuits.

11. The display assembly of claim 10 further comprising:

a first monitoring circuit in electrical connection with the first power supply, first LCD control circuit, and the first multiplexer.

12. The display assembly of claim 11 further comprising:

a second monitoring circuit in electrical connection with the second power supply, second LCD control circuit, and the first multiplexer.

13. The display assembly of claim 12 wherein:

the first and second monitoring circuits are adapted to analyze the electrical signals from the power supplies and control circuits to determine if an electrical connection has been interrupted.

14. The display assembly of claim 13 wherein:

the first and second monitoring circuits are further adapted to instruct the first multiplexer as to which power supply and associated control circuit signals to send to the LCD.

15. An electronic display assembly comprising:

a first power supply;

a second power supply;

an LED backlight;

a first LED control circuit in electrical connection with the first and second power supplies;

a second LED control circuit in electrical connection with the first and second power supplies;

a multiplexer for multiplexing input signals received from the first and second LED control circuits and providing a single output signal to the LED backlight;

a liquid crystal display (LCD) positioned in front of the LED backlight;

a third power supply;

a fourth power supply;

a first LCD control circuit in electrical connection with the third and fourth power supplies;

a second LCD control circuit in electrical connection with the third and fourth power supplies; and a first multiplexer for multiplexing input signals received from the first and second LCD control circuits and providing a single output signal to the LCD.

16. The system of claim 15 further comprising:

a second multiplexer accepting video data and in electrical connection with the first and second LCD control circuits.

17. The system of claim 16 further comprising:

a first LCD monitoring circuit which analyzes the electrical connections from the third power supply and first LCD control circuit; and a second LCD monitoring circuit which analyzes the electrical connections from the fourth power supply and second LCD control circuit.

18. The system of claim 17 wherein:

the first and second LCD monitoring circuits are further adapted to direct a third multiplexer to communicate either the electrical connection from the first LCD control circuit or second LCD control circuit to the LCD.

19. The system of claim 15 further comprising:

a first luminance sensor in electrical connection with the first LED control circuit; and a second luminance sensor in electrical connection with the second LED control circuit.

20. The system of claim 15 further comprising:

a first temperature sensor in electrical connection with the first LED control circuit; and a second temperature sensor in electrical connection with the second LED control circuit.

* * * * *